United States Patent [19]

Lipinski

[11] Patent Number: 4,939,983

[45] Date of Patent: Jul. 10, 1990

[54] FLUID PRESSURE OPERATED POSITIONING APPARATUS

[76] Inventor: Reinhard Lipinski, Beethovenstr. 75, D-7310 Plochingen, Fed. Rep. of Germany

[21] Appl. No.: 298,631

[22] Filed: Jan. 18, 1989

[30] Foreign Application Priority Data

Feb. 11, 1988 [DE] Fed. Rep. of Germany ..... 3804163

[51] Int. Cl.[5] ..... F01B 7/20

[52] U.S. Cl. ..... 92/62; 92/107; 92/114; 92/166

[58] Field of Search ..... 92/62, 63, 61, 65, 166, 92/113, 114, 115, 107, 108

[56] References Cited

U.S. PATENT DOCUMENTS

| | | | |
|---|---|---|---|
| Re. 23,892 | 11/1954 | Macewka | 92/62 X |
| 2,356,899 | 8/1944 | Stutter | 92/108 |
| 2,773,577 | 12/1956 | Kapenkin | 92/107 X |
| 2,955,578 | 10/1960 | Flessate et al. . | |
| 3,143,933 | 8/1964 | Norton . | |
| 3,172,338 | 3/1965 | Ackerman | 92/107 X |
| 3,797,365 | 3/1974 | Yoshikawa | 92/116 X |
| 3,904,416 | 9/1975 | Onoda et al. | 92/62 X |
| 3,986,438 | 10/1976 | Wittren | 92/108 X |

FOREIGN PATENT DOCUMENTS

| | | | |
|---|---|---|---|
| 2503069 | 7/1976 | Fed. Rep. of Germany . | |
| 7819942 | 3/1981 | Fed. Rep. of Germany . | |
| 1429500 | 1/1966 | France . | |
| 2496074 | 6/1982 | France . | |
| 5894608 | 6/1983 | Japan . | |
| 166107 | 10/1983 | Japan | 92/65 |
| 1190775 | 5/1970 | United Kingdom . | |
| 2058924 | 4/1981 | United Kingdom | 92/62 |

*Primary Examiner*—Edward K. Look

*Attorney, Agent, or Firm*—Frishauf, Holtz, Goodman & Woodward

[57] ABSTRACT

A fluid pressure operated positioning apparatus has a cylinder (1), formed as an annular cylinder, with an outer cylinder wall (2) and an inner cylinder wall (3) coaxial with and spaced apart radially from the outer cylinder wall. In the annular cylinder, a piston arrangement including at least one ring piston (8) is slidably guided, its ring piston surrounding the inner cylinder wall and being connected to at least one elongated force transfer element (22) that is extended in a sealed manner out of the annular cylinder.

14 Claims, 10 Drawing Sheets

FLUID PRESSURE OPERATED POSITIONING APPARATUS

The invention relates to a fluid pressure operated positioning apparatus that has at least one cylinder which is acted upon with a pressure fluid via connecting elements and is closed at its ends by cylinder caps, and at least one piston longitudinally slidable in the cylinder and supporting sealing elements. The positioning apparatus also has at least one force transfer element, such as a piston rod, connected to the piston and extending in a sealed manner out of the cylinder.

Background: Positioning apparatuses of this kind, in the form of single-action or dual-action pneumatic or hydraulic working cylinders, are widely used. When such working cylinders, in which the cylinder chamber is in principle surrounded by a tube forming the cylinder wall, with cylinder caps placed at the ends on the tube, are used, certain constructional restrictions must be taken into account. With elongated cylinders, the piston rod is capable of absorbing only relatively slight lateral loads, because as a rule bending of the extended piston rod cannot be allowed. Accordingly, in cases when a lateral load of this kind is to be expected, completely separate guide devices for the element driven by the piston rod must be provided; on occasion, still further structural provisions must be made, to assure the necessary rigidity of the guidance and its connection with the cylinder. Requirements in terms of stability and strength, dictated by the intended use, not infrequently also necessitate a relatively large cylinder diameter, which in turn means high air consumption or a high throughput of hydraulic oil, and hence high operating costs. Finally, there are applications in which in addition to the reciprocating motion generated by the piston rod, further rotational or translational drive motions for the element or device coupled to the piston rod are necessary. In such cases, separate additional drive assemblies must then be used, which are attached as units independent of the working cylinder to the outside of the cylinder wall or to the cylinder caps; thus they require considerable space, and sometimes also entail engineering expense for motion transfer elements located in between, and the like.

The Invention: It is an object to provide a fluid pressure operated positioning apparatus, which is distinguished by great stability and strength as well as rigidity, and which in comparison with a simple working cylinder of conventional design is distinguished by a substantially greater variety of possible uses.

Briefly, the cylinder is formed as a double wall structure to form a ring cylinder having an outer wall and an inner wall coaxial to and spaced apart from the outer walls, and the piston is a structure of ring shape, to form an annular piston which surrounds the inner cylinder wall.

In this apparatus, the cylinder basically comprises two concentric tubes closed at one end, between which the annular piston structure or arrangement is guided in a longitudinally slidable manner. The result is a cylinder of relatively great diameter that is stable and strong, while on the other hand, because of the annular cylinder chamber, the consumption of air or throughput of hydraulic fluid remains relatively low. The apparatus can be designed for air or hydraulic fluid as the pressure fluid, without any substantial change in its basic design.

The free space defined by the inner cylinder wall not only saves considerable weight but can also be utilized practically. To this end, in a preferred embodiment the arrangement is such that a coaxial passageway is defined by the inner cylinder wall connected to the annular cylinder cap. This free passageway can be used for receiving various accessories, which are thus accommodated without increasing the overall space required for the apparatus, and which enable versatile adaptation of the apparatus to the situation in a given use.

In an advantageous embodiment, the positioning apparatus may have axially parallel piston rods connected to the annular piston as the force transfer elements; they are extended in a sealed manner through one or both cylinder caps and joined to one another on the respective end of the piston. The piston rods are suitably distributed at least in groups on each end of the piston on a common pitch circle about the longitudinal axis of the annular cylinder. On each end of the piston, they may be connected to a support or guide element, for instance in the form of a mounting plate, which can simultaneously be used as a tool holder.

The use of a plurality of piston rods distributed annularly about the longitudinal axis of the cylinder makes possible the absorption of high lateral strains, since the cage-like structure attained with the aforementioned mounting plate permits only slight deflection of the extended piston rods, even under high lateral strain. The instrinsically rigid connection with the mounting plate assures great stability and strength.

In another embodiment, the positioning apparatus may have as its force transfer element a tube that is connected to and coaxial with the annular piston and extends in a sealed manner through at least one cylinder cap. Such a tube again has considerable bending strength, because of its considerable diameter, and therefore once again makes it possible to absorb considerable lateral strains. The tube may either form the inner cylinder wall directly, or the apparatus may be formed such that the tube extending through one cylinder cap is located surrounding the inner cylinder wall connected to the other cylinder cap and optionally is guided or supported on this inner wall.

DRAWINGS

DETAILED DESCRIPTION

Figure 1:
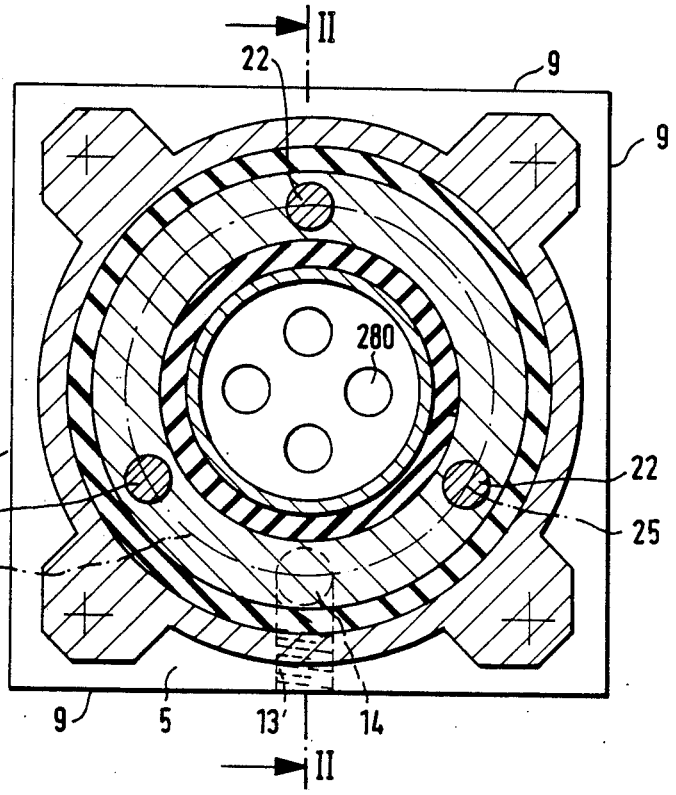
FIG. 1 is a plan view of a positioning apparatus according to the invention.

The positioning apparatus shown in various embodiments in the drawings makes it possible to produce linear positioning or actuating motions of limited length; in some embodiments, a rotational motion, or a further linear positioning or actuating motion at the equipment, or in general "elements", positioned or actuatable by the apparatus can additionally be generated.

A feature common to all the embodiments is that they have at least one ring cylinder 1 (FIG. 2) that can be acted upon by a gaseous or liquid pressure fluid, the cylinder being formed with an outer cylinder wall 2 and an inner cylinder wall 3 coaxial with and spaced apart from it; the annular cylinder chamber 4 of the cylinder is closed in a sealed manner on its end face by two substantially annular cylinder caps 5, 6. In the annular cylinder chamber 4, which is defined by two coaxial telescoping cylindrical smooth-walled tubes that form both the outer and inner cylinder walls 2 and 3, a piston structure 7 is longitudinally slidably guided, having at least one ring piston 8 that surrounds the inner cylinder wall 3, and has sealing means at its circumference that cooperate with the respective cylinder wall 2 or 3. At least one force transfer element is connected to the ring piston 8 and may be variously formed; in each case, however, it is extended to the outside in a sealed manner through at least one of the two cylinder caps 5, 6.

In all the embodiments, identical elements are identified by the same reference numerals and will be described only once, referring to FIGS. 1, 2:

The two annular cylinder caps 5, 6 have a square cross section, as can be seen in FIG. 1, thus providing flat mounting or attachment faces for the apparatus. Formed-on cylindrical ring shoulders 10, 11 have elastic sealing rings 12 inserted into corresponding annular grooves, and the sealing rings, in cooperation with the outer wall 2 and the inner wall 3 of the cylinder, seal off the cylinder chamber 4 in a fluid pressure-proof manner. The two cylinder caps 5, 6 are axially braced against one another by tension bolts, not shown in the drawing. Pressure fluid connection conduits 14, 15 having connection threads 13 and discharging into the cylinder chamber 4 on both sides of the ring pistons 8 are also formed in the two cylinder cap 5, 6.

The ring piston 8, in the embodiment shown, is in multiple parts. It comprises two rigid coaxial annular disks 16, which have a preferably plastic inner and outer cylindrical guide ring 17 and 18, respectively, and are rigidly connected to one another by a piston element 34 in the form of an annular plate. Elastic piston sealing rings 19, 20 are inserted into corresponding annular grooves and seal the ring piston 8 off from the outer and inner cylinder walls 2 and 3, respectively.

Cylindrical piston rods 22 that are parallel to the longitudinal axis 21 (see FIG. 2) of the ring cylinder are rigidly joined to the ring piston 8 via spring rings 23 slipped on both ends onto the ring piston 8, which are extended to the outside in a sealed manner through the cylinder cap 5 and are firmly joined, for instance screwed, on their outer ends to a common rigid mounting plate 24. The piston rods 22, which form the force transfer elements, are located with their axis 25 on a common pitch circle 26 (see FIG. 1), the three piston rods 22 being located at equal angular intervals. The result is an inherently stiff connection with the mounting plate 24, which makes it possible to absorb even strong lateral strains of the mounting plate 24 and piston rod 22. Depending on the strains to be expected, the number of piston rods 22 may also be selected to be higher than three; it is also possible to have only two diametrically opposed piston rods 22 in some embodiments. Ball bearing bushes 27 are introduced into suitable recesses of the cylinder cap 5 and provide additional lateral guidance of the piston rods 22, which further increases the lateral rigidity of the mounting plate 24, on which other elements, not shown, can be secured, for instance by means of the bores shown at 280 in FIG. 1.

Elastic sealing rings 28 placed in corresponding grooves of the cylinder cap 5, 6 serve to seal off the piston rods 22, and elastic pressure fluid wiper rings 29 are located preceding the sealing rings 28 toward the cylinder chamber 4.

Figure 2:
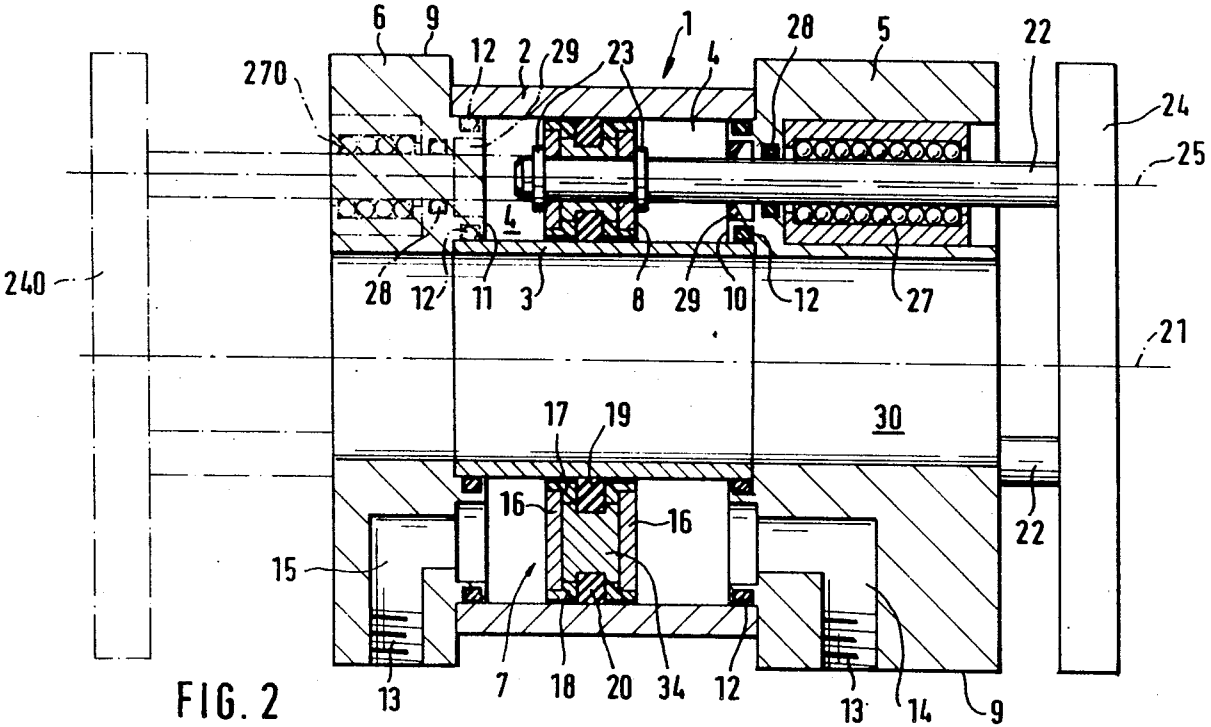
FIG. 2 is a sectional view along the line II—II of FIG. 1, in a schematic side view, showing the apparatus of FIG. 1.

If the particular use of the positioning apparatus described should make it useful to do so, then the piston rods 22 may be formed as continuous, as shown on the left in FIG. 2 by dashed lines. The piston rods 22 in this case are rigidly joined together on the side oriented toward the other cylinder cap 6, for instance via a second mounting or support plate 240, which may be formed similarly to the mounting plate 24 and upon a positioning motion of the ring piston 8 is moved in common with it. The elongated piston rods 22 in this case are laterally guided in the vicinity of the cylinder cap 6 as well by ball bearing bushes 270; the associated sealing rings and pressure medium wiper rings are again shown at 28 and 29.

The positioning apparatus described in conjunction with FIGS. 1, 2 can be used for all purposes in which it is important to generate a linear reciprocating motion of limited length, such as can be derived from the piston rod of a standard working cylinder of conventional design.

The inner cylinder wall 3 and the two annular cylinder caps 5, 6 define a free cylindrical passageway 30 that is coaxial to the longitudinal axis 21 of the ring cylinder and can be used for receiving supply or signal lines for the equipment located on the mounting plate 224 or 240, or can be used to accommodate additional assemblies, as will be described in further detail below.

While in the exemplary embodiment of FIG. 1, 2, described above, only one ring piston 8 is located in the cylinder chamber 4, the arrangement may also be such that, depending on the intended use, the piston structure 7 has more than one, for example two, ring pistons 8, which are either joined to one another by spacers and spaced apart mutually from one another or are independent from one another, and with which force transfer elements, such as the above-described piston rods 22, are correspondingly associated. In the latter case, the pressure fluid acts upon the ring piston 8 via the pistons or tubular force transfer elements themselves, for instance via the tubular piston rods 22. The two independent ring pistons 8 can then execute a motion extending away from and toward one another.

Figure 3:
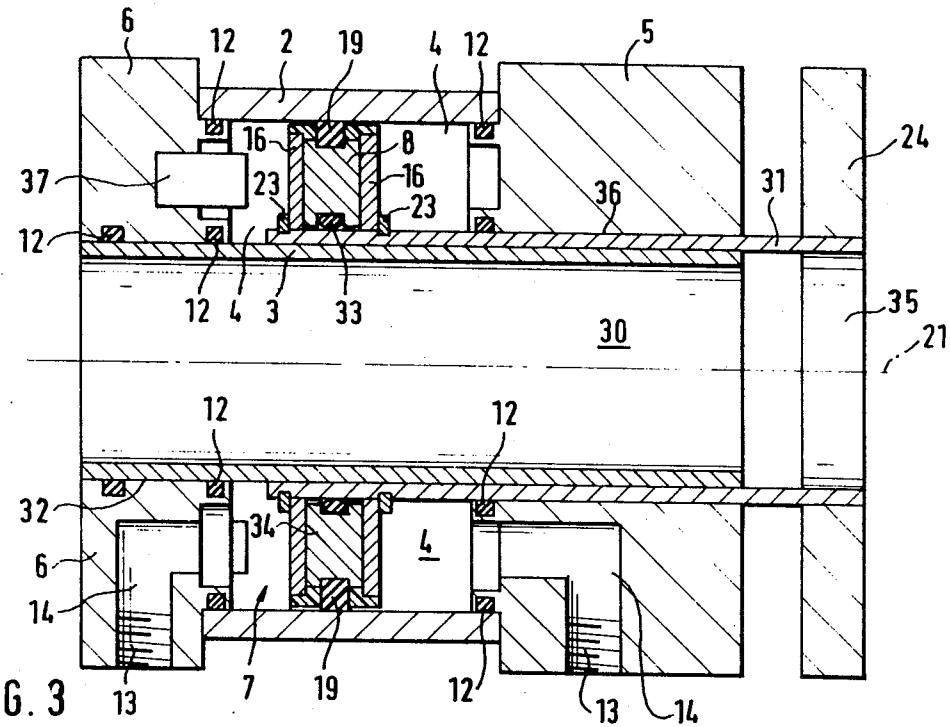
FIG. 3 is a schematic sectional view, similar to that of FIG. 2, of a second embodiment of a positioning apparatus according to the invention.

In the second embodiment shown in FIG. 3, the ring piston 8 of the piston structure 7 is rigidly joined via the spring rings 23 to a cylindrical tube 31, which forms the force transfer element and is coaxial with the longitudinal axis 21 of the ring cylinder. The tube 31 once again carries the mounting plate 24, which in this case is annular, on its end and surrounds the inner wall 3 of the cylinder, which is formed by a cylindrical, smooth-walled tube on which the tube 31 is slidably guided in a fluid pressure-proof manner. The inner cylinder wall 3 again defines the free passageway 30; in this case, this wall is pressed into a smooth-walled cylindrical through bore 32 located centrally in the cylinder cap 6 and is sealed off from the cylinder cap by sealing rings 12. The cylinder chamber 4 is once again sealed off from the outer cylinder wall 2 by sealing rings 12 that are placed in corresponding grooves, which simultaneously also provide sealing for the duct of the tube 31 through the other cylinder cap 5, as shown in FIG. 3.

A sealing ring 33, which is introduced into a corresponding annular groove of a ring piston element 34 located between the two annular disks 16 of the ring piston 8, seals the two cylinder chambers located on both sides of the ring piston 8 off from one another in the vicinity of the tube 31.

This embodiment is likewise distinguished by great lateral stability of the mounting or support plate 24; this is due to the telescoping arrangement of the tube 31, which is relatively large in diameter, and the tube that forms the inner cylinder wall 3. An advantageous feature for special applications is the fact that the passageway 30 continues past the central opening 35 of the assembly plate 24. Also, the tube 31 can be slidably guided in the vicinity of the cylinder cap 5 along the cylindrical inner face 36 of the through bore by its own bearing means, such as slide bearing boxes and the like.

Finally, on the side oriented toward the cylinder chamber 4, plug-lock or cushion-like elastic end position buffers 37 are introduced into the cylinder cap 6, which limit the reciprocating motion of the ring piston 8 and with which, on the opposite side, elastic end position damping elements inserted into the cylinder cap 5 can be associated. Such an elastic end position damper can also be provided in all the embodiments of the novel positioning apparatus; it is also possible for the damping elements 37 to be in the form of one or more encompassing rings.

For uses in which a continuous force transfer element is required, the modified embodiment of FIG. 4 may for instance be used, as follows:

In this embodiment, the continuous tube 31 at the same time forms the inner wall of the ring cylinder. Both cylinder caps 5, 6 are equipped with sealing rings 120, which rest on the outer wall of the cylindrical tube 31 and seal off the cylinder chamber 4 from the outside. In this embodiment as well, additional longitudinal bearings for the tube 31 may be provided in the vicinity of the cylinder caps 5, 6. A ring flange 38 located on the tube 31 serves to secure a mounting plate 24 (FIG. 3), which can be screwed to the other end of the tube, by way of example. The interior surrounded by the tube 31 once again forms the free passageway 30.

Figure 5:
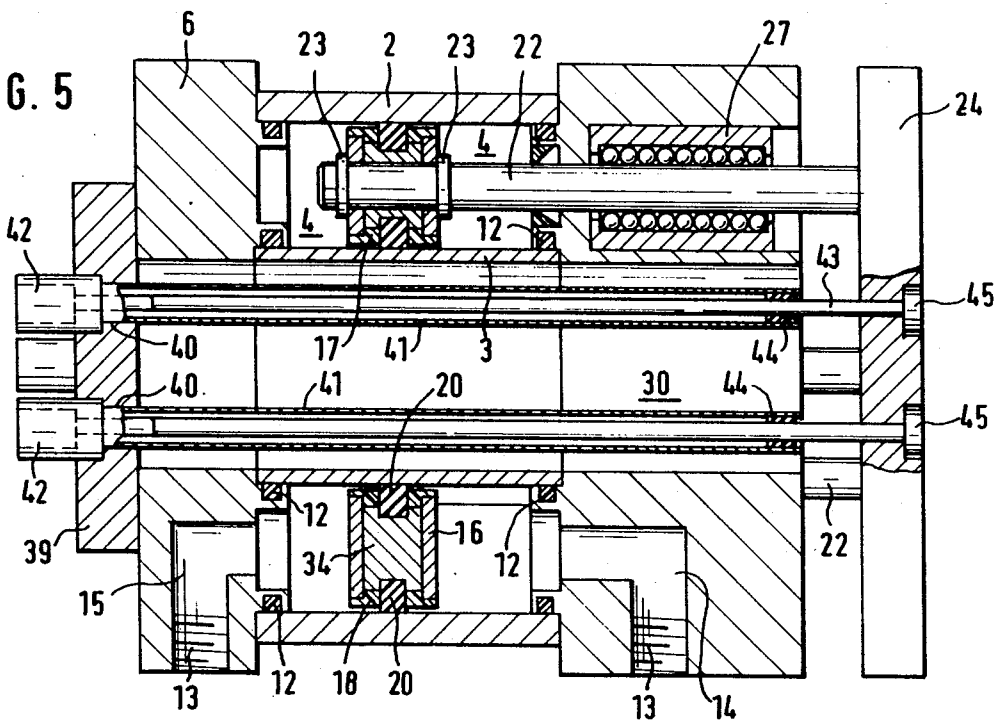
FIG. 5 is a schematic sectional view, similar to that of FIG. 2, of a fourth embodiment of a positioning apparatus according to the invention.

The fourth embodiment shown in FIG. 5 is substantially equivalent to that of FIGS. 1, 2. However, in this case supply devices for elements or equipment not shown in the drawing that is to be located on the mounting plate 24 are accommodated in the free passageway 30 defined by the inner cylinder wall 3. These supply devices, for supplying lubricating oil or compressed air, for example, have a mounting plate 39 mounted on the outside on the rear cylinder cap 6 and closing off the passageway 30; the plate 39 is provided with bores 40 into which supply tubes 41 with associated connection nipples 42 are rigidly inserted. The supply tubes extend parallel to one another substantially over the entire length of the passageway 30; in them, tubes 43 connected to the mounting plate 24 are slidable in telescoping fashion and are sealed off in a fluid-proof manner by ring seals 44 with respect to the supply tubes 41. The tubes 43 discharge into connection nipples 45 on the mounting plate 24.

As the drawings show, the arrangement is selected such that the aforementioned supply device for the equipment located on the mounting plate 24 virtually does not increase the total space requirement for the entire apparatus. Correspondingly, electrical supply devices can also be accommodated in the chamber 30. In any case, variable-length supply elements are provided, which assure that the reciprocating motion of the mounting plate 24 will not be hindered. When continuous force transfer elements 22 (see FIG. 2) are used, once again supply devices of this kind can be accommodated in the chamber 30, and this is equally applicable for all the other embodiments.

Figure 6:
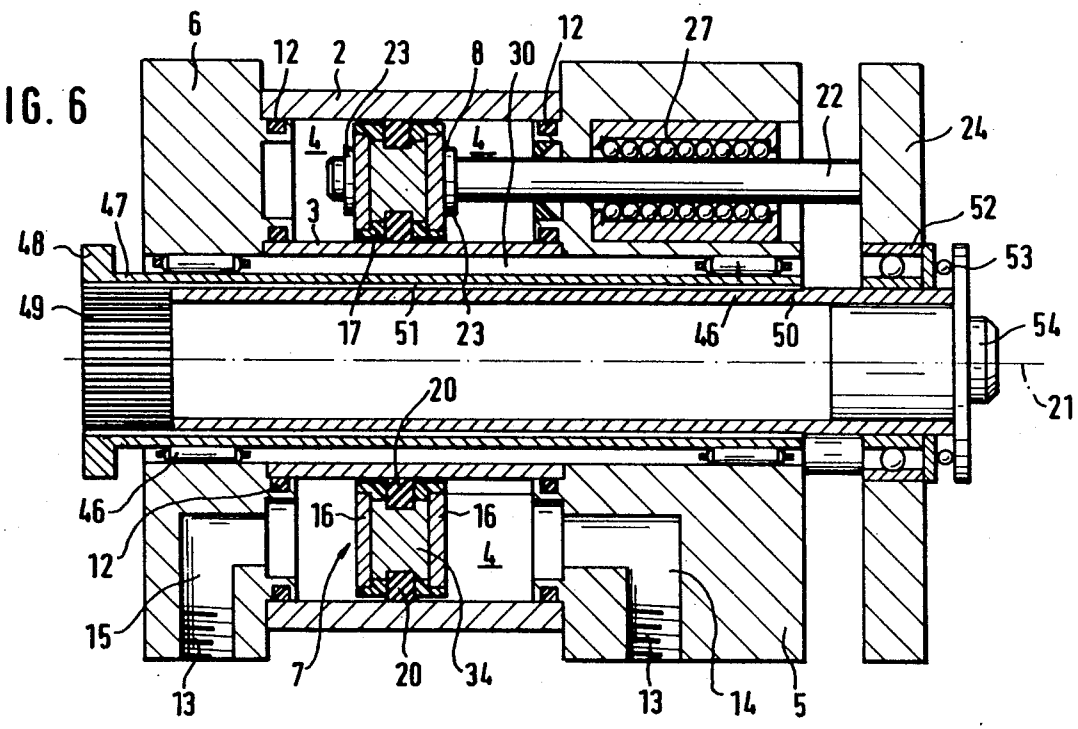
FIG. 6 is a schematic sectional view, similar to that of FIG. 2, of a fifth embodiment of a positioning apparatus according to the invention.

The further embodiment shown in FIG. 6 corresponds in its basic structure to that of FIGS. 1, 2. Here, the passageway 30 defined by the inner cylinder wall 3 is used to receive a drive mechanism, which makes it possible to impart a rotational motion about the longitudinal axis 21 of the ring cylinder to a device or element, not shown in the drawing, located on the mounting plate 24 independently of the linear positioning motion effected by the ring piston 8. To this end, a cylindrical hollow shaft 47 is rotatably supported in the cylindrical, smooth-walled passageway 30 via needle bearings 46; on its end protruding past the cylinder cap 6, the hollow shaft 47 has a connection flange 48 for a drive source, not shown in further detail, such as a motor mounted on the cylinder cap 6. On the inside, the hollow shaft 47 is provided with a spline at 49, with which a correspondingly splined drive shaft 50, which slides in telescoping fashion in the hollow shaft 47, meshes with its splines 51. The drive shaft 50 is supported such that it is rotatable but axially immovable on the annular mounting plate 24 via a radial roller bearing 52 and an axial roller bearing 53. The transferred rotational motion can be taken up by a journal 54 protruding from the front of the mounting plate 24. In certain cases, the journal 54 may also have a shaft coupling or may also be provided with splines, so that it permits the positioning apparatus having the ring piston 8, acting as a coupling actuation element, to engage or disengage the coupling thus formed.

Figure 4:
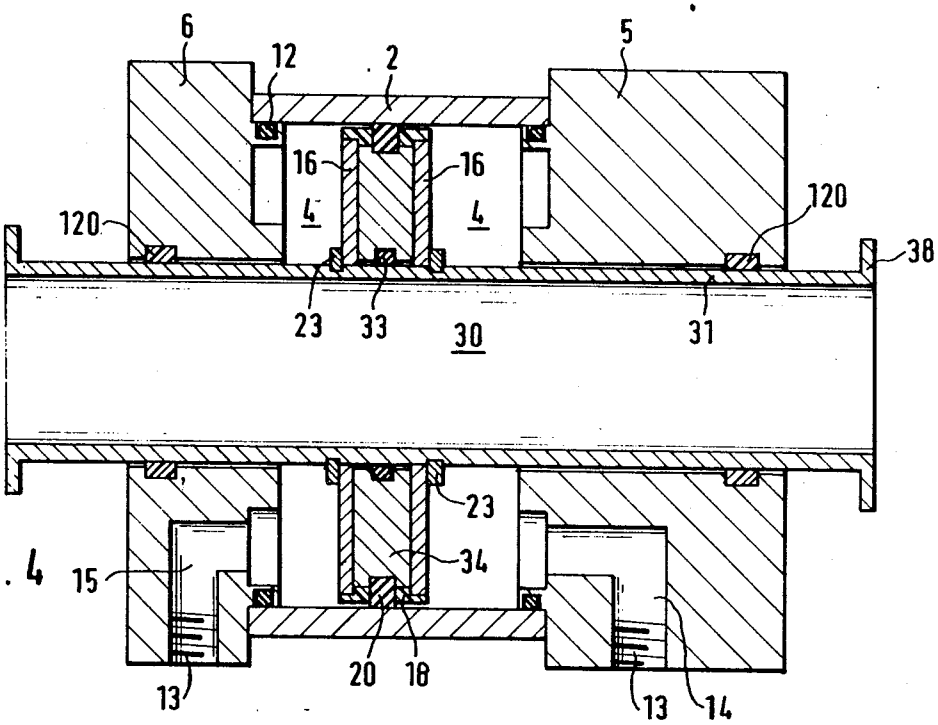
FIG. 4 is a schematic sectional view, similar to that of FIG. 2, of a third embodiment of a positioning apparatus according to the invention.

It will be understood that the rotary drive mechanism described can also be used in equivalent fashion for the embodiments of FIGS. 3, 4.

Figure 7:
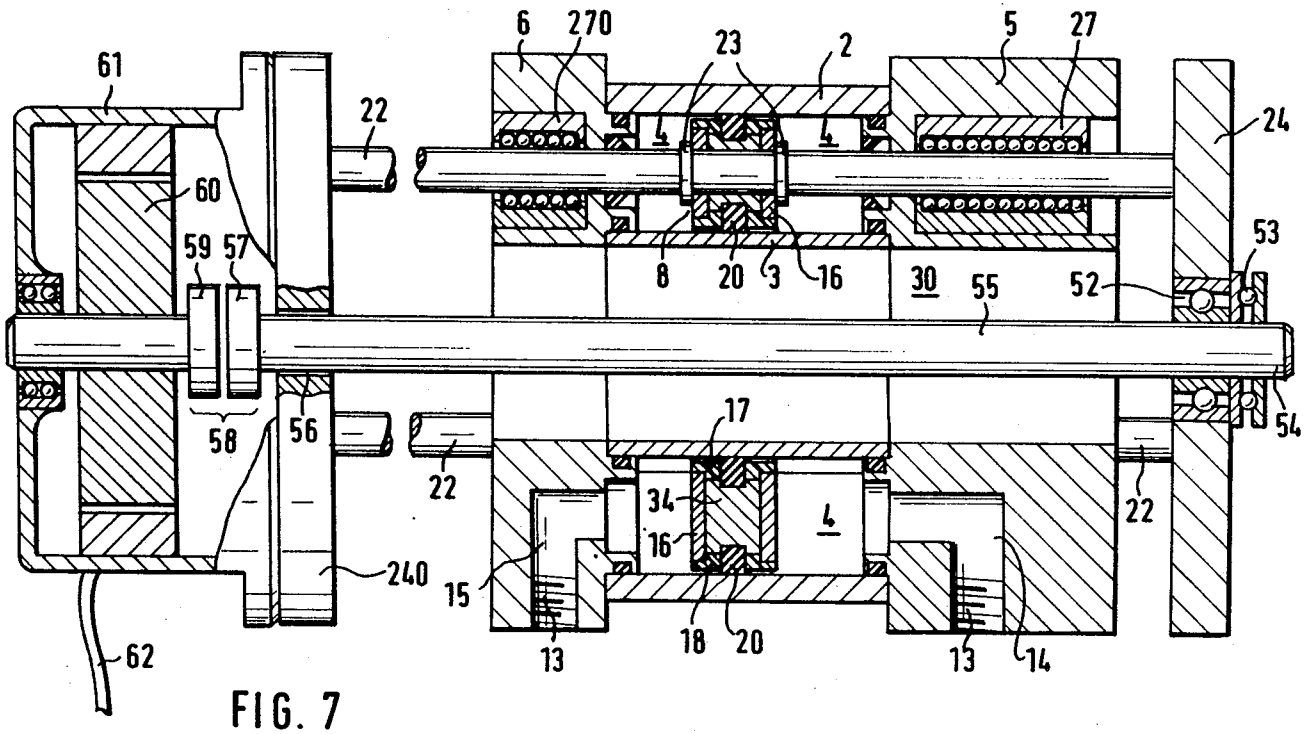
FIG. 7 is a schematic sectional view, similar to that of FIG. 2, of a sixth embodiment of a positioning apparatus according to the invention.

FIG. 7 shows a modified embodiment of the novel positioning apparatus, in which based on the embodiment of FIG. 2, the drive mechanism that generates the rotary drive motion in the vicinity of the mounting plate 24 is constructed differently, as follows:

In this case, a solid drive shaft 55 extends through the passageway 30 defined by the inner cylinder wall 3, and once again the drive shaft is supported rotatably but axially immovably on the mounting plate 24 by the radial roller bearing 52 and the axial roller bearing 53, similarly to what is shown in FIG. 6. Its protruding journal that permits the takeup of the rotational motion is again shown at 54.

On the opposite side, however, the drive shaft 55 extends through a central bore 56 of the second mounting plate 240 rigidly mounted on the continuous piston rods 22; the drive shaft may also be supported radially and/or axially in the vicinity of the bore 56. On its end, the drive shaft 55 has a coupling element, suggested at 57, of a preferably shiftable shaft coupling 58, the other coupling element 59 of which is coupled in a manner fixed against relative rotation to the rotor 60 of a electric motor 61, shown schematically, mounted on the second mounting plate 240. Since the spacing between the two mounting plates 24, 240 is defined by the piston rods 22 and hence is invariable, the telescoping embodiment of the drive shaft 55 is unnecessary in this embodiment. As a result, however, the electric motor 61 follows up the positioning motion of the mounting plate 24 and hence is equipped with flexible supply lines 62.

Figure 8:
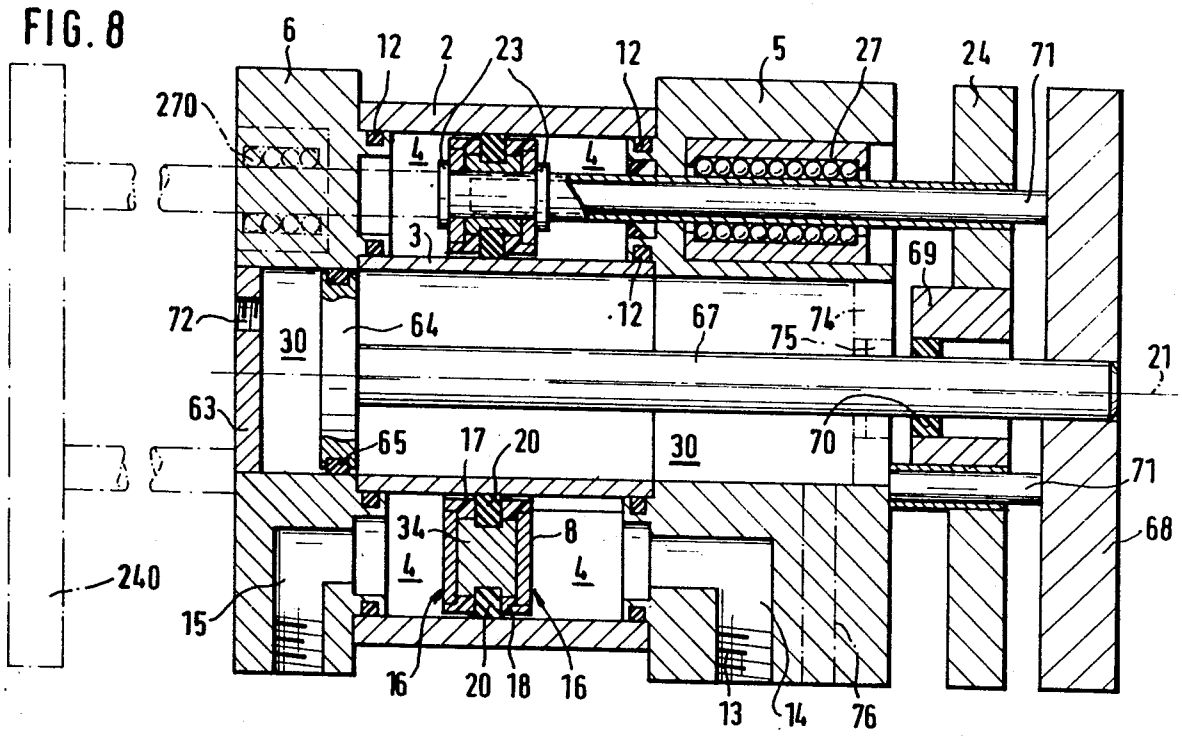
FIG. 8 is a schematic sectional view, similar to that of FIG. 2, of a seventh embodiment of a positioning apparatus according to the invention.

For applications in which in addition to the positioning motion of the mounting plate 24 generated by the ring piston 8 a linear positioning motion independent thereof and causing an elongation of the stroke is necessary, the embodiments shown in FIGS. 8, 9 can be used, as follows:

In the embodiment of FIG. 8, the passageway 30 defined by the inner cylinder wall 3 is closed in a fluid pressure-proof manner in the vicinity of the cylinder cap 6 by a closure wall 63. It directly forms a cylinder chamber, coaxial with the longitudinal axis 21 of the ring cylinder, for a stroke cylinder, the slidable piston 64 of which is sealed off from the inner wall of this cylinder chamber by a piston seal 65 placed in a corresponding annular groove. A coaxial piston rod 67, forming a stroke element, is joined to the piston 64 and screwed at its end to a support plate 68. The support plate 68 is located before the mounting plate 24, which is rigidly joined to the piston rods 22; the mounting plate 24 is annular and is provided at its center with a guide bush 69, in which the piston rod 67 is radially guided by an elastic guide ring 70.

The piston rods 22 joined to the ring piston 8 are also formed as tubes; in them, cylindrical guide rods 71 are slidable, secured with mutually parallel alignment on the support plate 68 and laterally guiding it together with the piston rod 67.

If the mounting plate 24 is displaced toward the right as seen in FIG. 8 by the application of an appropriate pressure fluid to the cylinder chamber 4, then the mounting plate carries the support plate 68 along with it, so that the elements located thereon execute a corresponding linear reciprocating motion. Subsequently, via a pressure fluid connection 72 in the closure wall 63, the piston 64 can be subjected to pressure fluid, causing the support plate 68 to execute an excess stroke with respect to the mounting plate 24. The restoring motion can be generated by elastic restoring elements, such as a spring, not shown; however, it is readily possible for the piston 64 to be bidirectional. To this end, the piston rod 64 need merely be sealed off from the cylinder cap 5; the associated annular closure parts and sealing means introduced into the passageway 30 are shown in dashed lines in FIG. 8 and are marked 74 and 75, respectively.

An additional supply conduit 76 for pressure fluid in the cylinder cap 5 serves to supply fluid to the cylinder chamber located on the end of the piston facing the support plate 68.

Naturally, the piston rods 22 in this embodiment as well may be continuous and may be joined at the ends to a second mounting plate 240 on the other side of the cylinder. This is shown in dashed lines in FIG. 8. For special cases, the piston rod 67 could be continuous as well.

Alternatively, a conventional working cylinder available in commerce, and an associated piston rod, could be introduced into the passageway 30.

Figure 9:
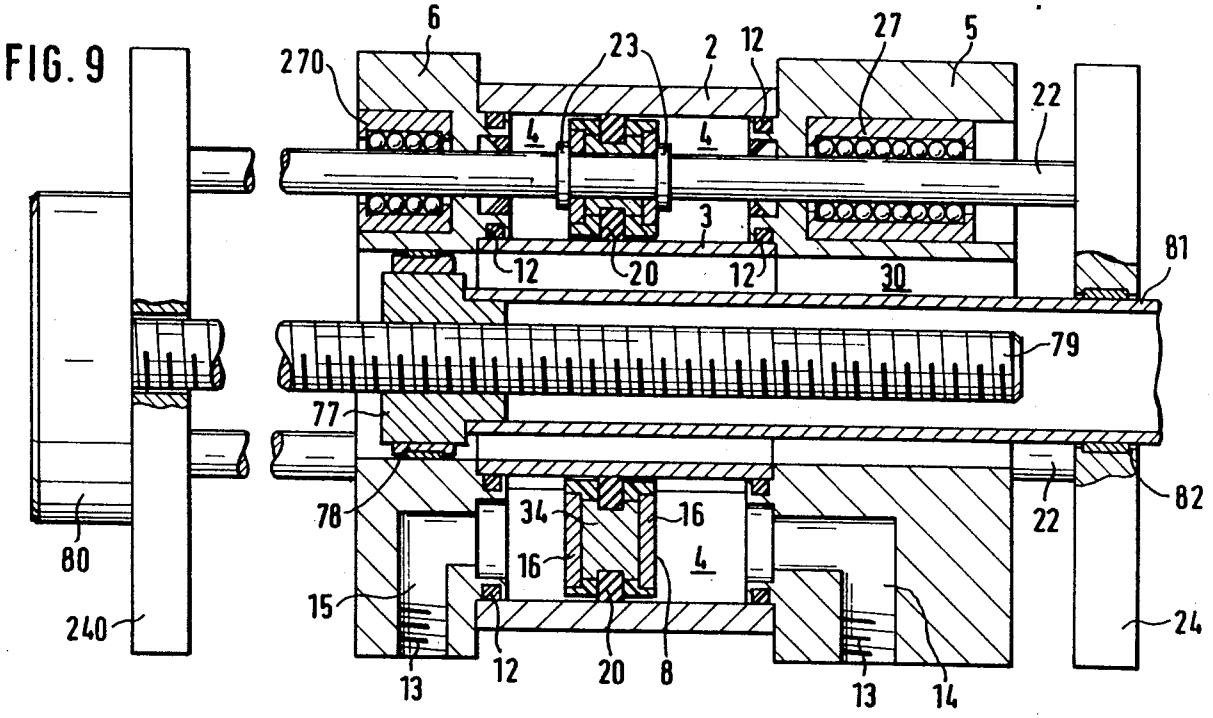
FIG. 9 is a schematic sectional view, similar to that of FIG. 2, of a eighth embodiment of a positioning apparatus according to the invention.

In the embodiment of FIG. 9, the lengthening of the stroke is generated mechanically. To this end, a spindle nut 77 is guided radially and longitudinally slidably via a slide bearing ring 78 in the cylindrical passageway 30 defined by the inner cylinder wall 3; together with a coaxial threaded spindle 79, the spindle nut 77 forms a spindle drive located in the passageway 30. The piston rods 22 joined to the ring piston 8 are continuous; mounted on the second mounting plate 240 is an electric motor 80, which is coupled to the threaded spindle 77 and sets it into rotation. A coaxial drive tube 81 is connected to the spindle nut 77 in a manner fixed against relative rotation, extending through a corresponding central through bore of the mounting plate 24 and being supported in it at 82 such that it is longitudinally slidable but is not rotatable.

If the threaded spindle 79 is set into rotation by the drive motor 80, then the spindle nut 77 displaces the drive tube 81 in the passageway 30, so that regardless of the positioning motion of the mounting plate 24, or of some element joined with it, a linear positioning or actuating motion can be transmitted.

The arrangement may also be the reverse of what has been described above, with the drive tube 81 driven by the electric motor, mounted for instance on the mounting plate 24, while the threaded spindle 79 is joined to the second mounting plate 240 in a manner fixed against relative rotation.

For applications in which it is important to furnish not only the reciprocating motion generated by the ring piston 8 and the above-described additional linear positioning or actuating motion on a moved or actuated element, but a rotational motion as well, the structural details of the embodiments of FIGS. 8, 9 can be combined with those of the embodiments of FIGS. 5, 6. This may for instance may be done such that the drive shaft 55 of FIG. 7 is formed extending through the tubular threaded spindle 79 of FIG. 9, to give only one possible example.

The embodiments in which a linear positioning or actuating motion is generated in addition to the reciprocating motion brought about by the ring piston 8 are particularly suitable for use in designing robots or handling equipment. In these cases, gripper means, the actuation of which is derived from the piston rod 67, the drive tube 81 or the drive element 55, or from the force transfer element or elements or in other words from the piston rods 22 or the tube 31, for instance, may be connected directly to the force transfer element or elements 31, 22.

Figure 10:
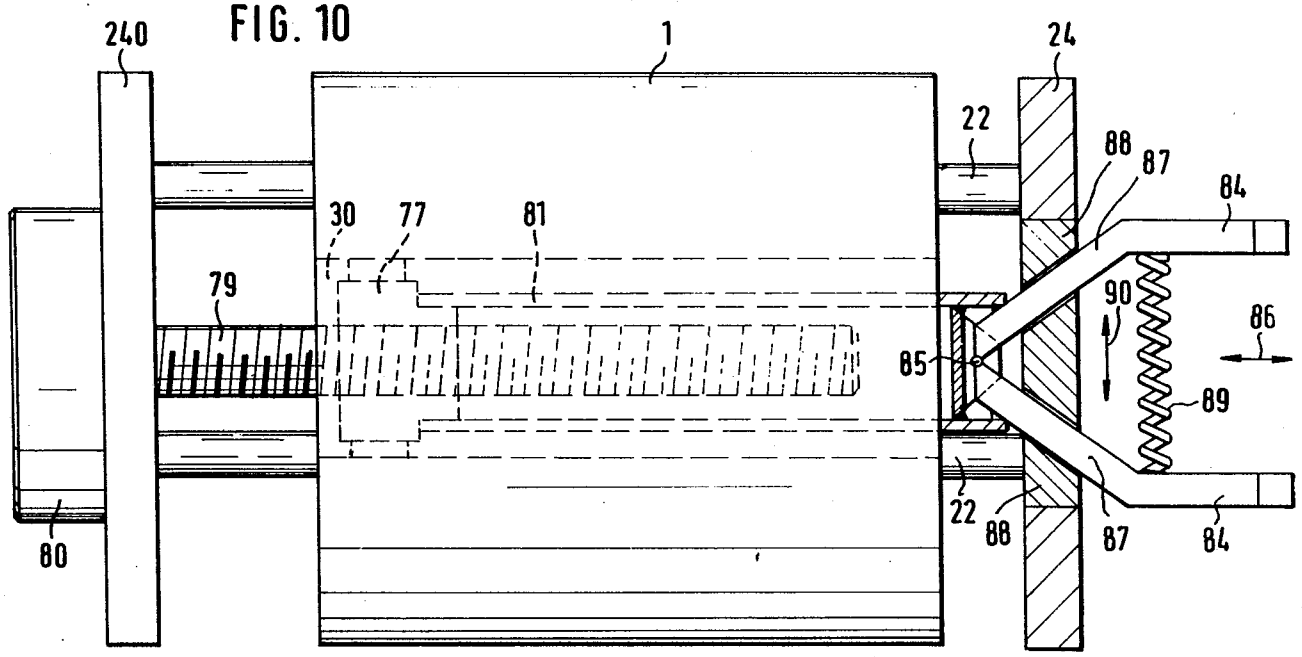
FIG. 10 is a schematic basic side view of the positioning apparatus according to the invention in an embodiment as a gripper unit.

One example of this application, based on the embodiment of FIG. 9, is shown in FIG. 10:

Gripper jaws 84 are mounted such that they are pivotable toward one another about a common transverse axis 85 on the drive tube 81, such that by the drive motor 80, they can be moved back and forth in common in the direction of an arrow 86. Actuating wedges 88, which engage the outside of nearly schematically shown gripper jaw legs 87 that converge toward the pivot axis 85, are joined to the annular mounting plate 24, so that in a simple manner, the gripper jaws 84, urged in the opening direction by a compression spring 89, are opened or closed in the direction of the double arrow 90 via the piston rods 22 joined to the ring piston, upon a linear displacement of the mounting plate 24.

Clamping tongs, parallel grippers, three-point grippers, and the like can be actuated in a similar manner; it should also be noted that this can be done pneumatically or hydraulically, in the embodiment of FIG. 8.

If the apparatus has elastic end position damping means for the ring piston in the annular cylinder chamber, this has the advantage that separate fixtures or construction positions located on the outside are not required for damping the end position.

In the passageway defined by the inner cylinder wall, energy or signal supply devices for at least one device or element connected to the force transfer element or elements may be provided; these supply devices have connection means attached to the cylinder and supply means, beginning at the attachment means and leading to the device or element and equipped to accommodate changes in spacing, so that the device or element connected to the supply devices can execute the reciprocating motion imparted to it by the positioning apparatus without hindrance. It is suitable for the supply line means to have telescoping supply line elements of adjustable length.

In addition or alternatively, a drive mechanism that generates a rotational motion can be located in the passageway that is defined by the inner cylinder wall and is optionally closed on one end; the drive mechanism may have at least one driven drive element that is coaxial with the longitudinal axis of the ring cylinder. This converts the positioning apparatus into a rotary feed unit, which can be used in many kinds of applications, such as in grinding, honing, polishing, brushing, drilling, and countersinking, to name only a few.

The encompassing drive element may be adjustable in length and supported on at least one force transfer element, or on some part, such as a mounting plate, connected to a force transfer element. This makes it possible to have a drive source for a rotational motion available directly on the mounting plate, which is longitudinally adjustable by the positioning apparatus, without requiring greater space for the overall unit. A simple structure is also attained if the drive mechanism has a drive shaft rotatably supported in the free space and capable of being coupled to a drive source; the drive element is then connected axially displaceably but in a manner secured against relative rotation with the drive shaft. The drive shaft and/or the drive element may advantageously be formed as a splined hollow shaft, although other suitable embodiments are also possible.

The drive mechanism that generates the rotational motion may have a drive shaft extending through the inner passage of the cylinder as well, this drive shaft extending between a drive source and a coupling position for a driven element. The drive source and the coupling position, located on opposite ends of the cylinder, are connected to the force transfer element or elements that extends through both cylinder caps. In this embodiment, the drive source for the rotary motion executes the reciprocating or stroke motion as well. If the drive source is an electric motor, then this embodiment, with the motor located outside the passageway of the cylinder, has the advantage of better lost heat dissipation.

Alternatively, or in addition, the novel positioning apparatus can also be formed such that the passageway defined by the inner cylinder wall has a linear stroke element, with at least one stroke member that is adjustable independently of the ring piston. This produces a linear unit in the form of a bidirectional cylinder, with which not only the actual positioning motion can be performed but the stroke can be lengthened as well, which can be done pneumatically, hydraulically or mechanically.

In this connection it should be noted that this linear stroke element may also be combined in addition with a drive element that generates a rotary motion, resulting in a rotary feed unit with the option of stroke lengthening. In a pneumatic or hydraulic version, the stroke element may have a piston that is displaceable either in the passageway formed as a stroke cylinder and defined by the inner cylinder wall, or in a stroke cylinder inserted into the passageway; this piston is connected to the at least one stroke member, which is extended in a sealed manner through at least one of the two closure elements on the ends of the stroke cylinder. Such an apparatus is particularly suitable as a feed unit, but the arrangement may also be such that the stroke member is connected to at least one adjusting member, which is longitudinally slidable with respect to the force transfer element or elements and thus is provided, via the stroke member, with an additional motion that serves to actuate it.

For use as a feed unit for accurate positioning, the stroke element may for instance also have a spindle drive, the threaded spindle or threaded nut of which forms at least one stroke member or is connected to such a stroke member.

Regardless of the embodiment, stop means that limit the stroke at the ring piston may also be located in the passageway defined by the inner cylinder wall; this may be useful for instance if the apparatus is used as a short-stroke cylinder unit with an adjustable fixed stop, with or without an additional drive mechanism for a rotary motion and with or without stroke lengthening. Such an apparatus, equipped with clamping tongs and with an adjustable fixed stop, may also be used as a rod feed unit for sawing, lathes, and so forth.

In applications in which major lateral strains can be expected at the extending force transfer element or elements, it may be advantageous for the force transfer element or elements to be guided in a longitudinally slidable manner in the respectively associated cylinder cap. Because of its versatility, the novel positioning apparatus is particularly advantageously used for robots, handling equipment and the like. For example, a suitable embodiment for this purpose is one in which gripper means are connected to the force transfer element or elements, the actuating element of the gripper means being coupled to the stroke or drive element of the aforementioned stroke or drive mechanism.

Various changes may be made and any features described in connection with any embodiments can be used with any others, within the scope of the inventive concept.

I claim:

1. Fluid pressure operated positioning apparatus having an elongated cylinder element (1) closed at both ends;

a piston element (7, 8) slidable in said cylinder element; and means for applying a pressure fluid to at least one side of the piston element to shift the position of the piston element axially with respect to the cylinder element, the cylinder element (1) forming a ring cylinder having an outer wall (2) and a hollow inner wall (3) radially spaced from said outer wall, the interior of said inner wall defining a coaxial passageway (30), said piston element comprising a ring piston having a ring structure (7) surrounding the inner cylinder wall (3), and positioned within the outer wall (2);

end closure means (63, 64) closing off the inner cylinder wall (3);

a linear stroke element (64; 77, 79) movable within said passageway (30) and positionable independently of the ring piston element (8) with respect thereto; and wherein said linear stroke element comprises a spindle drive (77, 79), including mutually threaded spindle-spindle nut elements, at least one of said elements being coupled to said stroke element.

2. The apparatus of claim 1, including a plurality of axially parallel piston rods (22) coupled to the ring piston, and forming force transfer elements, said piston rods extending in sealed manner through at least one of said end closure means (5, 6; 63, 74), and means coupling said parallel piston rods together at a respective side of the piston.

3. The apparatus of claim 2, wherein the piston rids (22) on each side of the piston are distributed at least in groups, each on a common pitch circle (26), about the longitudinal axis (21) of the ring cylinder.

4. The apparatus of claim 2, further including a holder or guide element (24; 240) coupling the piston rods at each side of the piston and remote therefrom, externally of said cylinder element.

5. Fluid pressure operated positioning apparatus having an elongated cylinder element (1) closed at both ends;

a piston element (7, 8) slidable in said cylinder element; and means for applying a pressure fluid to at least one side of the piston element to shift the position of the piston element axially with respect to the cylinder element, the cylinder element (1) forming a ring cylinder having an outer wall (2) and a hollow inner wall (3) radially spaced from said outer wall, the interior of said inner wall defining a coaxial passageway (30), said piston element comprising a ring piston having a ring structure (7) surrounding the inner cylinder wall (3), and positioned within the outer wall (2);

end closure means (63, 64) closing off the inner cylinder wall (3);

a linear stroke element (64; 77, 79) movable within said passageway (30) and positionable independently of the ring piston element (8) with respect thereto; and a stroke cylinder insert combination comprising coaxially nested relatively movable axially extending elements (79, 81) and positionable independently with respect to each other and with respect to said piston element (8).

6. The apparatus of claim 5, including a plurality of axially parallel piston rods (22) coupled to the ring piston, and forming force transfer elements, said piston rods extending in sealed manner through at least one of said end closure means (5, 6; 63, 74), and means coupling said parallel piston rods together at a respective side of the piston.

7. The apparatus of claim 6, wherein the piston rods (22) on each side of the piston are distributed at least in groups, each on a common pitch circle (26), about the longitudinal axis (21) of the ring cylinder.

8. The apparatus of claim 6, further including a holder or guide element (24; 240) coupling the piston rods at each side of the piston and remote therefrom, externally of said cylinder element.

9. The apparatus of claim 5, further including a tubular structure (31) connected to the ;ring piston and coaxial therewith to form a force transfer element, said tubular structure (31) extending, in a sealed manner, through at least one of said end closure means.

10. The apparatus of claim 5, wherein said linear stroke element comprises a piston (64) slidable in said passageway and a piston rod (67) coupled thereto, said piston rod passing, in sealed manner, through said end closure means of said cylinder element.

11. The apparatus of claim 10, further comprising a positioning element (68) coupled to said piston rod (67) said piston rod being longitudinally slidably guided and controlled with respect to the ring piston (8).

12. The apparatus of claim 5, further including gripper means (84) and gripper operating means (59, 67, 81) coupled to said gripper means for operating said gripper means, said gripper means being coupled to said linear stroke element.

13. The apparatus of claim 12, wherein said gripper means includes a rotatable drive element (54).

14. The apparatus of claim 12, wherein said gripper means includes means for longitudinally moving said gripper means under control of at least one of: said ring piston element and said linear stroke element.

* * * * *